United States Patent [19]

Lange et al.

[11] 3,989,985

[45] Nov. 2, 1976

[54] SURGE VOLTAGE ARRESTER

[75] Inventors: Gerhard Lange; Gerhard Peche, both of Berlin, Germany

[73] Assignee: Siemens Aktiengesellschaft, Berlin & Munich, Germany

[22] Filed: July 31, 1974

[21] Appl. No.: 493,264

[30] Foreign Application Priority Data

Sept. 13, 1973 Germany ..... 2346174

[52] U.S. Cl. ..... 317/61; 317/62

[51] Int. Cl.[2] ..... H01J 1/46

[58] Field of Search ..... 317/61, 62

[56] References Cited

UNITED STATES PATENTS

| | | | |
|---|---|---|---|
| 3,588,576 | 6/1971 | Kawiecki | 317/61 X |
| 3,813,577 | 5/1974 | Kawiecki | 317/62 X |
| 3,818,259 | 6/1974 | Schleimann | 317/62 |

*Primary Examiner*—Mark O. Budd
*Assistant Examiner*—Harry Moose
*Attorney, Agent, or Firm*—Hill, Gross, Simpson, Van Santen, Steadman, Chiara & Simpson

[57] ABSTRACT

A surge voltage arrester includes a gas-tight housing in which electrodes are arranged opposite one another so as to form a gap, and are inserted into the ends of a tube-shaped insulating body on the inside of which at least one strip of electrically conductive material, an ignition strip, extends over a part of the length of the tube commencing from one electrode toward the other electrode. The strip of electrically conductive material extends beyond the gap and the elements of the arrester are relatively disposed such that the distance of the end of the strip of electrically conductive material to the other electrode is greater than the gap between the electrodes.

8 Claims, 4 Drawing Figures

SURGE VOLTAGE ARRESTER

BACKGROUND OF THE INVENTION

1. Field of the Invention

This invention relates to a surge voltage arrester with a gastight housing in which electrodes are arranged opposite one another, forming a gap, and are inserted into the ends of a tube-shaped insulating body having an inner surface which carries at least one strip of electrically conductive material as an ignition strip, the strip extending over a part of the tube length commencing from one electrode toward the other electrode.

2. Description of the Prior Art

It is known in the art that in order to reduce the ignition voltage in gas discharge tubes one may apply ignition strips of electrically conductive material to the tube-shaped insulating body of a gas discharge tube. For example, reference may be taken to German Pat. No. 1,070,733. In surge voltage arresters of this kind, the filling of the arrester with radioactive preparates is avoided, or at least substantially reduced. The ignition strips are preferably applied to the inside of the insulating body and in each case are connected to an electrode.

In the case of rapidly rising surge voltages (impulse sparkover voltage) surge voltage arresters are to ignite as quickly as possible. In the German published application No. 2,032,899 the application of ignition strips to a ceramic body in order to achieve a rapid response of the surge voltage arrester is disclosed. The ignition strip can be either electrically conductively connected to the electrodes or not so connected to the electrodes. The embodiment in which the ignition strip is electrically connected to the electrodes is preferred. A metallic solder is employed as a connection element. In the known surge voltage arrester, the ignition strip is designed in such a manner that it terminates at a distance in front of the counter electrode at the level of the gap formed between the two electrodes, so that it is not possible for an arc flashover to take place between the ignition strip and the counter electrode. In a particular embodiment of that invention, the ignition strip is electrically connected to one of the electrodes and extends in the direction toward the other electrode, wherein the ignition strip terminates at a distance before the other electrode, which distance is greater than the gap between the two electrodes. In this known series voltage arrester it is very difficult to apply to the insulating body ignition strips which end very precisely at a specific point which has a greater distance from the counter electrode than the distance between the two electrodes.

SUMMARY OF THE INVENTION

The object of the invention is to provide a surge voltage arrester, having an ignition strip, in such a manner that the impulse spark-over voltage of the arrester is unaffected by the distance between the ignition strip and the counter electrode.

The foregoing object is realized in a surge voltage arrester of the type described above wherein, according to the invention, the strip which consists of electrically conductive material extends beyond the height of the gap and the distance from the end of the strip of electrically conductive material to the other electrode is greater than the gap between the two electrodes.

An advantage which is achieved in practicing the invention is that as a result of the special design of the strip of electrically conductive material, the impulse spark-over voltage of the surge voltage arrester is unaffected by the distance between the ignition strip from the counter electrode.

A further advantage results from the use of frustum-shaped electrodes which are used in so-called knob arresters. In these cases, the electrodes run from the active part of the electrode surface in a conical shape to the junction points which connect the electrodes to the insulating body. When this shape of electrode is used, the distance between the insulating body and the counter electrode at the height of the combustion chamber which forms a gap is greater than the distance between the active electrode components. The ignition strips extend beyond the center of the insulating body into the region of the counter electrode on the inner walls of the insulating body without the impulse spark-over voltage of the surge voltage arrester being influenced by the distance of the ignition strip from the counter electrode. Therefore, it is possible to use ignition strips of different lengths if only the distance to the counter electrode is greater than the distance between the main electrodes.

BRIEF DESCRIPTION OF THE DRAWINGS

Other objects, features and advantages of the invention, together with its organization, construction and operation will be best understood from the following detailed description taken in conjunction with the accompanying drawings, on which.

DESCRIPTION OF THE PREFERRED EMBODIMENTS

Figure 1:
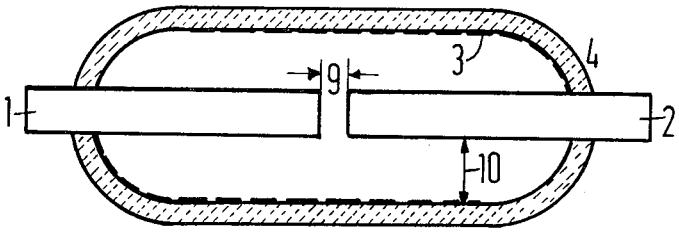
FIG. 1 is a longitudinal sectional view of a simplified illustration of a surge voltage arrester constructed in accordance with the invention.

The surge voltage arrester illustrated in FIG. 1 comprises a tube-shaped insulating body 4 into the narrow ends of which electrodes 1 and 2 are inserted in a gastight fashion. The electrodes 1 and 2 are arranged opposite one another within the insulating body 4 so as to form a gap 9. The insulating body 4 consists, for example, of ceramic.

A strip 3 extends from each electrode 1 and 2. The strip 3 has been illustrated in broken lines to improve the clarity of the drawings. The strip 3 consists of electrically conductive material, and is hereinafter referred to as an ignition strip. The strip of conductive material 3 extends from one electrode toward the other a distance to pass beyond the gap 9 and terminate prior to reaching the other electrode. The elements are so constructed that the strip 3 is disposed at a distance 10 which is greater than the gap 9 between the two electrodes 1 and 2. The ignition strip 3 expediently consists of graphite. For example, this strip may be applied to the insulating body 4 by being rubbed off a graphite pencil lead. However, the ignition strip can also consist of a graphite suspension, for example, a so-called Hydrokollag.

Figure 2:
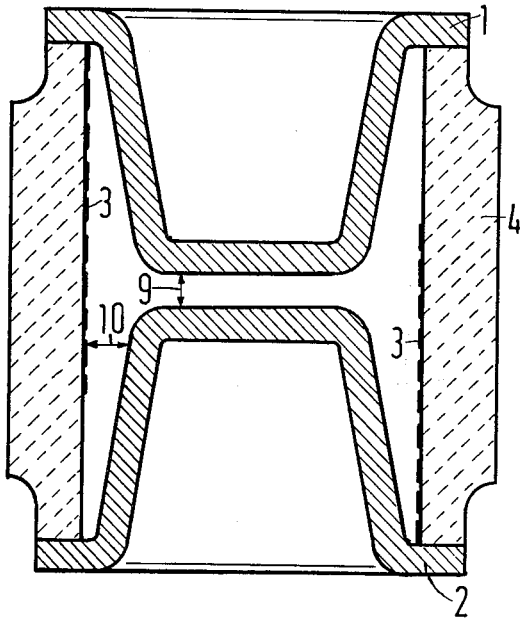
FIG. 2 is a longitudinal sectional view of a surge voltage arrester in the form of a knob arrester.

FIG. 2 illustrates another surge voltage arrester constructed in accordance with the invention. Because of its special shape, this surge voltage arrester is also referred to as a knob arrester. The gas-tight housing is formed by two frustum-shaped electrodes 1 and 2 and the cylindrical insulating body 4 into which the electrodes 1 and 2 are inserted in such a manner that their curved portions face one another and are arranged opposite one another so as to form a gap 9 within the insulating body 4. The ignition strips 3 extend from the respective electrodes 1 and 2 and lie opposite one another beyond the height of the gap 9 and in each case terminate before reaching the other electrode at a distance 10 which is greater than the gap 9 between the two electrodes 1 and 2. At the sides of the tube-shaped insulating body 4 is a shoulder; the edges of the electrodes do not project beyond this shoulder. This ensures that the surge voltage arrester of the invention is suitable for insulated installation in tube-shaped holders.

Figure 3:
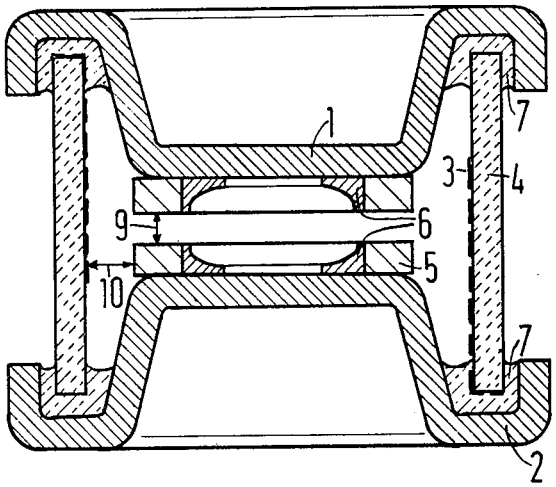
FIG. 3 is a longitudinal sectional view of another embodiment of a surge voltage arrester in the form of a knob arrester.

FIG. 3 illustrates another surge voltage arrester in the form of a knob arrester. In this surge voltage arrester, the two electrodes 1 and 2 are again designed with a frustum shape and are inserted with their curved portions, which face one another, into the ends of the tube-shaped insulating body 4. In this exemplary embodiment of the invention, each of the electrodes 1 and 2 is provided at its end faces, which are arranged opposite one another, with a metallic ring 5 which makes the electrodes 1 and 2 hollow electrodes. An activation layer 6, consisting of a material of high electron emissive capacity is arranged on the electrodes 1 and 2 with the ring 5. The activation layer 6 can, because of the cavity which is formed within the metallic ring 5, be applied in a large quantity while achieving good adhesion. Therefore, feed cathode properties are achieved in the two electrodes 1 and 2 with their rings 5. In addition, in this embodiment, the gas volume in the operative gap can expand more easily so that the insulating body 4 of the gas-tight housing is practically spared of all danger from inner pressure waves, even in the case of high current loads on the electrodes 1 and 2. If the ring 5 is designed to have a sharp outer upper edge, a low alien ignition voltage is obtained because the sharp edge seals the field lines and therefore the field strength is increased. The ignition strips 3 again extend from the ends of the tube-shaped insulating body commencing from the one electrode (1 or 2) in the direction toward the other electrode (2 or 1) beyond the height of the operative gap 9, wherein the ignition strip 3 ends before the other electrode at a distanc 10 which is greater than the gap 9 between the two electrodes which carry the rings 5 and an activation layer 6.

As in the case of the other exemplary embodiments, the ignition strip 3 can be electrically conductively connected to the respective electrodes 1 and 2. This connection is produced, for example, by the soldering of the electrodes 1 and 2 with the metallized insulating body 4 which consist of, for example, ceramic. Occasionally, however, it is expedient to arrange the beginning of the strip 3 on one end side of the insulating body 4 at an insulated distance from the respective electrode 1 or 2 in such a manner that the ignition strip 3 is capacitively coupled to the respective electrode. For this purpose, in the surge voltage arrester illustrated in FIG. 3, there is provided a glass layer 7 which is preferably suitable as a dielectric and into which the ignition strip 3 is embedded at the end side of the insulating body 4. This capacitive coupling of the ignition strip to the electrodes has the advantage that when a partial attenuation of the insulating body is provided it is possible to permit an inner connection of the ignition strips 3 which lie opposite one another because the glass layer 7 which is used as a dielectric maintains the insulation of the ignition strips 3 to the electrodes 1 and 2.

Furthermore, it has been shown that in the production of the surge voltage arrester of the invention it is possible to directly contact the ignition strips 3 with the electrodes 1 and 2, even when glass is used as a fusion material. In this way, it is possible to avoid, in part, expensive metal soldering between the insulating body 4 on the one hand and the electrodes 1 and 2 on the other hand.

Figure 4:
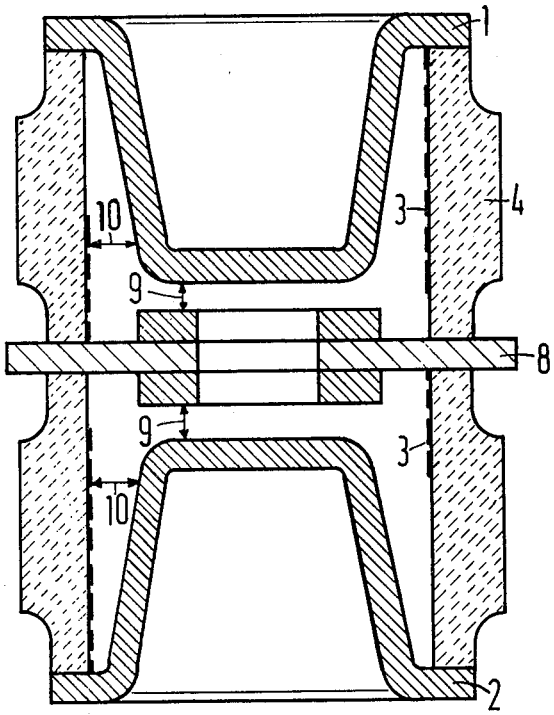
FIG. 4 is a longitudinal sectional view of a further embodiment of a surge voltage arrester in the form of a multi-path arrester.

FIG. 4 illustrates a further exemplary embodiment of a surge voltage arrester in the form of a so-called multi-path arrester. In this multi-path arrester, the two electrodes 1 and 2 are again of frustum-shape and, with their curve portions which face one another, are inserted in a gas-tight manner into the ends of the insulating body 4. The insulating body 4 is divided at its center into two homogeneous halves by a metallic ring plate which forms a ring electrode 8 and which engages into the air gap between the electrodes 1 and 2. Therefore, two gap zones 9 are formed by the ring electrode 8 and the two frustum-shaped electrodes 1 and 2. The ignition strips 3 extend, in each case, from the ends of the insulating body 4 both from the one electrode to the ring shaped electrode 8 and also from the ring shaped electrode 8 to the other frustum shaped electrode beyond the height of the two gaps 9 and the distance 10 of the ignition strip 3 to the other electrode (1, 2 and 8) is greater than the distance between the frustum shaped electrodes 1 and 2 which forms the gaps with the ring electrode 8. The shoulder at the end sides of the tube-shaped insulating body 4 again serves to ensure an insulated installation of the surge voltage arrester into tube-shaped holders.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A surge voltage arrester comprising:

a gas-tight housing including a tube-shaped insulating body having an inner surface;

a pair of electrodes extending into said body and sealed thereto, each of said electrodes including a surface spaced from the like surface of the other electrode to define a gap; and at least one conductive strip carried on said inner surface of said body, Said conductive strip extending from one of said electrodes toward the other of said electrodes a distance beyond said gap, said electrodes disposed with respect to said inner surface such that said conductive strip is spaced from said other electrode a distance greater than the length of said gap.

2. A surge voltage arrester according to claim 1, wherein said conductive strip is electrically connected to said one electrode.

3. A surge voltage arrester according to claim 1, wherein an end portion of said conductive strip is disposed at a predetermined distance from said one electrode to provide capacitive coupling therebetween.

4. A surge voltage arrester according to claim 1, comprising: a glass layer at the connection to said one electrode to said body, the adjacent end of said strip embedded in said glass layer.

5. A surge voltage arrester according to claim 1, comprising:

a pair of said conductive strips extending in opposite directions; and glass portions carried on opposite ends of said body embedding the adjacent ends of respective conductive strips.

6. A surge voltage arrester according to claim 1, wherein each of said electrodes comprises a frustum shaped cup including a portion having the gap defining surface.

7. A surge voltage arrester according to claim 1, wherein said conductive strip comprises graphite.

8. A surge voltage arrester comprising:

a gas-tight housing including a tube-shaped insulating body having an inner surface;

a metallic ring plate extending through said body to divide the interior thereof into two parts, a pair of electrodes extending into said body and sealed thereto, each of said electrodes including a surface spaced from said ring plate to define a respective gap therebetween; and at least one conductive strip carried on said inner surface of said body, said conductive strip extending from one of said electrode toward the other of said electrodes a distance beyond the respective gap, said electrodes disposed with respect to said inner surface such that said conductive strip is spaced from said other electrode a distance greater than the distance between the electrodes which form said gaps.

* * * * *